US008426090B2

(12) United States Patent
Sakka et al.

(10) Patent No.: US 8,426,090 B2
(45) Date of Patent: Apr. 23, 2013

(54) INTERMEDIATE TRANSFER MEMBER COMPRISING AN INORGANIC LAYER, AND IMAGE FORMING METHOD AND IMAGE FORMING APPARATUS EMPLOYING THEREOF

(75) Inventors: Kenji Sakka, Hino (JP); Yuichiro Maehara, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 818 days.

(21) Appl. No.: 12/522,221

(22) PCT Filed: Dec. 20, 2007

(86) PCT No.: PCT/JP2007/074506

§ 371 (c)(1),
(2), (4) Date: Jul. 6, 2009

(87) PCT Pub. No.: WO2008/084643

PCT Pub. Date: Jul. 17, 2008

(65) Prior Publication Data

US 2010/0054782 A1 Mar. 4, 2010

(30) Foreign Application Priority Data

Jan. 9, 2007 (JP) ..... 2007-001151

(51) Int. Cl.
*G03G 13/01* (2006.01)

(52) U.S. Cl.
USPC ..... 430/47.4; 399/301; 399/302; 399/308

(58) Field of Classification Search ..... 430/47.1, 430/47.2, 47.4
See application file for complete search history.

(56) References Cited

U.S. PATENT DOCUMENTS 3,893,761 A * 7/1975 Buchan et al. ..... 399/308
5,761,594 A 6/1998 Seto et al.

(Continued)

FOREIGN PATENT DOCUMENTS

DE 19542612 A1 5/1996
EP 1947526 A1 7/2008

(Continued)

OTHER PUBLICATIONS

English machine translation of Japanese patent document Matsushita (JP 2004-240176). Note that the original reference was cited by Applicant in the IDS submission of Jul. 6, 2009.*
Supplementary European Search Report for EP Application No. 07850941 dated Mar. 24, 2011.

(Continued)

*Primary Examiner* — David Gray
*Assistant Examiner* — Geoffrey Evans
(74) *Attorney, Agent, or Firm* — Cantor Colburn LLP

(57) ABSTRACT

It is an object to provide an intermediate transfer member that maintains a good second transferability and a good cleaning property even when print is repeatedly carried out and continuously obtains a high quality toner image without the occurrence of a non-printing portion of a character image, and an image forming method and a image forming device that use the intermediate transfer member. The intermediate transfer member is used for an image forming device provided with a means which, after the toner image carried on a surface of a photosensitive member is first transferred to the intermediate transfer member, the toner image is second transferred to a transfer member. The intermediate transfer member is characterized in that including an inorganic layer on the most outer surface, wherein the inorganic layer defines a contact angle of 30°-60° with respect to methylene iodide and the hardness of the inorganic layer measured by a nanoindentation method is in the range of 3 GPa-10 GPa.

16 Claims, 6 Drawing Sheets

U.S. PATENT DOCUMENTS

| | | | | |
|---|---|---|---|---|
| 8,219,011 | B2 * | 7/2012 | Maehara et al. | 399/308 |
| 8,295,747 | B2 * | 10/2012 | Sakka et al. | 399/302 |
| 2007/0188585 | A1 * | 8/2007 | Mochizuki et al. | 347/140 |
| 2008/0267675 | A1 * | 10/2008 | Maehara | 399/308 |
| 2008/0310890 | A1 * | 12/2008 | Inada et al. | 399/302 |
| 2009/0041514 | A1 * | 2/2009 | Maehara | 399/308 |
| 2009/0060598 | A1 * | 3/2009 | Kondo et al. | 399/297 |
| 2009/0074477 | A1 * | 3/2009 | Mori et al. | 399/308 |
| 2009/0258312 | A1 * | 10/2009 | Hayata et al. | 430/125.3 |
| 2010/0158583 | A1 * | 6/2010 | Sakka et al. | 399/302 |
| 2010/0232843 | A1 * | 9/2010 | Kouno | 399/302 |
| 2011/0206422 | A1 * | 8/2011 | Hirose et al. | 399/308 |
| 2012/0027473 | A1 * | 2/2012 | Yamashita et al. | 399/308 |

FOREIGN PATENT DOCUMENTS

| | | | |
|---|---|---|---|
| JP | 8-211755 | A | 8/1996 |
| JP | 9-212004 | A | 8/1997 |
| JP | 2000-248356 | A | 9/2000 |
| JP | 2004-240176 | A | 8/2004 |
| JP | 2006-79016 | A | 3/2006 |
| JP | 2006-215076 | A | 8/2006 |
| WO | 2006/129543 | A1 | 12/2006 |

OTHER PUBLICATIONS

International Search Report for International Application No. PCT/JP2007/074506 mailed Jan. 29, 2008 with English Translation.

* cited by examiner

INTERMEDIATE TRANSFER MEMBER COMPRISING AN INORGANIC LAYER, AND IMAGE FORMING METHOD AND IMAGE FORMING APPARATUS EMPLOYING THEREOF

CROSS REFERENCE

This is a U.S. national stage application of International Application No. PCT/JP2007/074506, filed on 20 Dec. 2007. Priority under 35 U.S.C. §119(a) and 35 U.S.C. §365(b) is claimed from Japanese Application No. JP2007-001151, filed 9 Jan. 2007, the disclosure of which is also incorporated herein by reference.

TECHNICAL FIELD

This invention is directed to an intermediate transfer member, and an image forming method and an image forming apparatus employing thereof.

BACKGROUND

An image forming method employing an intermediate transfer member is known as a method for transferring a toner image hold on a surface of an electrophotographic photoreceptor ("photoreceptor") to a transferee material conventionally. The final image is obtained by a process such that a toner image on a photoreceptor is primarily transferred to an intermediate transfer member, and then secondarily transferred from the intermediate transfer member to the transferee material in this image forming method. This method is a multiple transfer method wherein an image original is reproduced by utilizing subtractive color process employing color toners such as black, cyan, magenta and yellow, and each color toner image is primarily transferred from the photoreceptor to the intermediate transfer member in sequence and finally all color toners are transferred from the intermediate transfer member to the transferee material at once in a so called full color image forming apparatus However image defect may be liable to occur due to transfer defect because the multiple transfer method includes two transfer process of the first and secondary transfer, and a plurality of toner images are superposed on the intermediate transfer member the superposed toner image is transferred to the transferee material at once.

It is known that transfer performance can be improved by modifying it such that surface of toner particles is treated with an external additive such as silica for transfer defect of toners in general. However there is a problem of not obtaining good transfer performance because silica particles are released from toner particles or embedded into inside toner particles due to stress suffered from toner stirrer or regulation blade for forming toner layer on a developer roller, or stress suffered between photoreceptor and developer roller.

A method is proposed to improve secondary transfer performance by modifying it such that that surface energy of the photoreceptor is allowed to be lower than that of the intermediate transfer member due to reducing surface energy of the intermediate transfer member (See, for example, Patent Document 1).

The other method is proposed to prevent generation of hollow characters by suppressing aggregation of toner on the intermediate transfer member by modifying it such that improving secondary transfer performance by reducing surface energy of the intermediate transfer member and further introducing elastic layer in the intermediate member (See, for example, Patent Document 2).

However, toner particles are liable to aggregate and this cause problem generating hollow characters frequently because the surface energy of the intermediate transfer member is reduced in the intermediate transfer member described in the Patent Document 1. There was a problem that quality of transferred image is degraded because cleaning performance to remove residual toner is degraded and the surface of the intermediate transfer member is stained by toner or so (toner filming), when printing is continued, for example, 100,000 sheets employing the intermediate transfer member described in Patent Document 2.

(Patent Document 1): JP-A H08-211755

(Patent Document 2): JP-A 2006-79016

DESCRIPTION OF THE INVENTION

Technical Problem to be Solved by this Invention

An object of this invention is to provide an intermediate transfer member by which good secondary transfer performance and good cleaning performance are maintained and high quality toner image without hollow characters is obtained continuously when printing is repeated, and an image forming method and image forming apparatus employing the intermediate transfer member.

Technical Means to Dissolve Problem

1. An intermediate transfer member employed in an image forming apparatus which includes means of, after primarily transferring a toner image held on a surface of an electrophotographic photoreceptor to an intermediate transfer member, secondarily transferring the toner image from the intermediate transfer member to a transferee material, wherein the intermediate transfer member comprises an inorganic layer provided at uppermost thereof, contact angle of the inorganic layer against methylene iodide is 30 to 60°, and a hardness of the inorganic layer measured by a nanoindentation method is 3-10 GPa.

2. The intermediate transfer member, described in the item 1 above, wherein 10 points average surface roughness Rz of the inorganic layer is 30 to 300 nm measured by employing an atomic force microscope.

3. The intermediate transfer member, described in the items 1 or 2 above, wherein internal stress of the inorganic layer is not more than 100 MPa and not less than 0.01 MPa in plus area.

4. The intermediate transfer member, described in any one of the items 1 to 3 above, wherein the inorganic layer is formed of at least one of silicon oxide layer and metal oxide layer.

5. The intermediate transfer member, described in any one of the items 1 to 4 above, wherein the inorganic layer is formed by atmospheric pressure plasma CVD.

6. The intermediate transfer member, described in any one of the items 1 to 5 above, wherein a substrate of the intermediate transfer member is a resin.

7. The intermediate transfer member, described in item 6 above, wherein the substrate of the intermediate transfer member is polycarbonate, polyimide or polyphenylene sulfide.

8. An image forming method employing the intermediate transfer member described in any one of items 1 to 7 above.

9. An image forming apparatus employing the intermediate transfer member described in any one of items 1 to 7 above.

10. An image forming apparatus which includes means of, after primary transferring a toner image hold on a surface of an electrophotographic photoreceptor to an intermediate transfer member, secondary transferring the toner image from the intermediate transfer member to a transferee material, wherein relationship of dispersive component of surface energy of the electrophotographic photoreceptor and dispersive component of surface energy of the intermediate transfer member is that (dispersive component of surface energy of the electrophotographic photoreceptor)≦(dispersive component of surface energy of the intermediate transfer member).

Advantage of the Invention

The intermediate transfer member and the image forming method and image forming apparatus employing the intermediate transfer member have excellent advantage that good Secondary transfer performance and good cleaning performance are maintained, and high quality toner image free from hollow characters is obtained continuously when printing is repeated.

DESCRIPTION OF SYMBOLS

Figure 1:
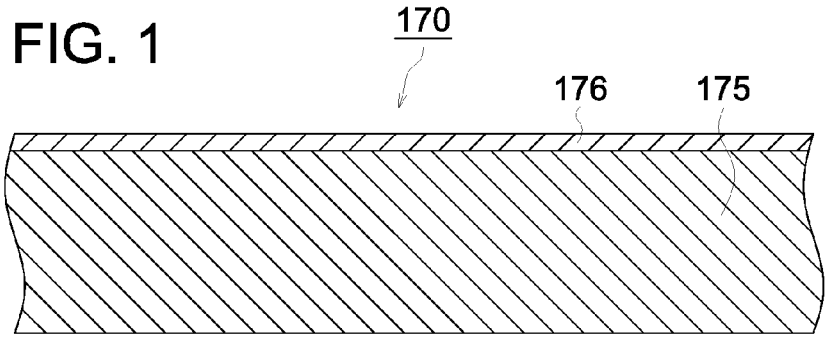
FIG. 1: Conceptual sectional schematic view showing layer arrangement of the intermediate transfer member.

170: Intermediate transfer member
175: Substrate
176: Inorganic layer

BEST EMBODIMENT PRACTICING THIS INVENTION

The inventors have found that good transfer performance and good cleaning performance are maintained and high quality of toner image without hollow characters are obtained by controlling a contact angle of the intermediate transfer member surface against methylene chloride and a hardness of the intermediate transfer member surface as a result of various study to dissolve the problems described above.

Though a reason are not clarified well why good transfer performance and good cleaning performance are maintained and high quality of toner image hollow characters are restrained by controlling a contact angle of the intermediate transfer member surface against methylene chloride and a hardness of the intermediate transfer member, the followings are supposed.

When a surface energy of the intermediate transfer member is made lower (contact angle against methylene iodide is made lower), adhesive force between the intermediate transfer member and a toner becomes weak and therefore transfer efficiency (secondary transfer efficiency) to a transferee material becomes enhanced, however adhesive force between toner particles becomes strong and therefore aggregation of toner particles is liable to occur to cause hollow characters.

It is supposed when a surface energy of the intermediate transfer member is made higher to the contrarily, hollow characters is inhibited because adhesive force between toner particles becomes weak but secondary transfer efficiency to the transferee deteriorate.

Otherwise, considering surface hardness of the intermediate transfer member, the intermediate transfer member is subjected to force in a direction of compression between a photoreceptor and the intermediate transfer member during primary transfer from the photoreceptor to the intermediate transfer member. The intermediate transfer member is considered to deform by being pressed by toners between the photoreceptor and the intermediate transfer member in this instance. Deformation quantity is small when the surface of the intermediate transfer member is hard, and therefore contact area between toner and the intermediate transfer member becomes narrow. That is, toner has good releasing characteristics and secondary transfer performance is supposed to be improved by allowing the hardness of the intermediate transfer member as stipulated in the present invention.

In view of the foregoing, it considered to satisfy compatibility of the Secondary transfer performance and hollow characters by stipulating the contact angle against methylene iodide and surface hardness to specific values in this invention.

The intermediate transfer member is subjected to cleaning in which residual toner escaped from transfer is removed via cleaning member such as cleaning blade after toner is secondary transferred to a transferee material. It is considered that the residual toner is removed efficiently by cleaning member when the intermediate transfer member has characteristics as stipulated in this invention.

A high quality toner image can be obtained continuingly without print image stain due to insufficient cleaning with minimized deterioration of transfer performance due to toner filming as a result.

It has been found that the hollow character deficiency is improved and by dispersive component of surface energy is made high among the three components of surface energy (dispersive component, dipole component, and hydrogen bond component) of surface free energy, and the other components are less effective as a result of study of the intermediate transfer medium for improving hollow characters performance. It was also found that a value of contact angle against methylene iodide is predominant for dispersive component of the surface energy among water, methylene iodide and bromonaphthalene (nitromethane) used for surface energy measurement, and the dispersive component can be controlled by a contact angle value of against methylene iodide. It was found that hollow character deficiency in which center portion of line in the character image or so remains escaping transfer is prevented when a multiple color toner image on the intermediate transfer member is transferred to a transferee at once.

Dispersive component of the surface energy was further studied, and it was found that it is effective for the hollow character deficiency when the dispersive component of the surface energy of the intermediate transfer member is higher than that of the photoreceptor. It was found that an intermediate transfer member with excellent hollow character performance can be provided by satisfying magnitude relation as described in claim 3 of this application restricted to dispersive component as (dispersive component of the surface energy of the photoreceptor)≦(dispersive component of the surface energy of the intermediate transfer member) but not the magnitude relation of surface energy as a whole, that is, (the surface energy of the photoreceptor)≦(the surface energy of the intermediate transfer member) as described in JP A H08-211755.

It was found that an excellent secondary transfer performance as well as preventing hollow character occurrence compatibly continuingly by employing an intermediate transfer member having surface energy of specific value and hardness as a result of study described above.

A contact angle of an inorganic layer of the inorganic layer measured against methylene iodide is 30 to 60°, and preferably 35 to 50°.

A hardness of the inorganic layer measured by nanoindentation method is 3 to 10 GPa, and preferably 4 to 6 GPa.

Cleaning member is not damaged, no scratch is generated and therefore high transfer performance can be obtained continuingly and generation of hollow characteristic can be prevented by control in the above mentioned range. Advantage improving secondary transfer performance is lessen in certain degree when 3 GPa or less. It is liable to generate an insufficient adhesion between a substrate and the inorganic layer or cracking of the inorganic layer.

Ten points average surface roughness Rz is preferably 30 to 300 nm and more preferably 30 to 200 nm, measured by employing an atomic force microscope for 10 μmsquare of the intermediate transfer member.

It is liable to generate a problem in which cleaning blade turns over during cleaning process removing toner remained on an intermediate transfer member with cleaning blade after the transfer when due to high friction Rz is less than 30 nm.

The secondary transfer is inhibited due to roughness on the surface further to generation of cleaning deficiency with a cleaning blade when Rz is more than 300 nm.

Further internal stress of the inorganic layer is preferably not more than 200 MPa and not less than 0.01 MPa, and more preferably 100 MPa and not less than 0.1 MPa in plus area.

Good cleaning performance can be maintained by controlling the internal stress of the intermediate transfer member in the above described range.

This invention is described in detail.

The intermediate transfer member comprises an inorganic layer on a substrate.

FIG. 1 shows a conceptual sectional view of layer arrangement of an example an intermediate transfer member Symbols 170, 175 and 176 show an intermediate transfer member, a substrate and an inorganic layer, respectively in FIG. 1.

The intermediate transfer member 170 comprises the inorganic layer 176 on the substrate 175.

Each layer is described.

The substrate is preferably a seamless belt or a drum, composed of resin material in which an electroconductive material is dispersed. A thickness of the belt is preferably 50-700 μm, and drum 1 mm or more. The substrate is preferably a flexible seamless belt in this invention.

The inorganic layer is preferably a silicon oxide or metal oxide film formed via plasma CVD. Practical example includes a metal oxide film such as silicon oxide, silicon nitride oxide, silicon nitride, titanium oxide, titanium nitride oxide, titanium nitride and aluminum oxide, and silicon oxide film is preferable among them. Inorganic compound of their mixture is also preferably used.

The inorganic layer is provided one layer or more.

Thickness of the inorganic layer is 100-1,000 nm, preferably 150-500 nm, more preferably 200-400 nm.

Thickness is measured using a measuring instrument Model MXP21 manufactured by MacScience Inc. Practically copper is employed as a target of the X-ray source, and operation is performed at 42 kV with 500 mA. A multi-layer film parabolic mirror is used as an incident monochrometer. A 0.05 mm×5 mm incident slit and a 0.03 mm×20 mm light receiving slit are employed. According to the 2θ/θ scanning technique, measurement is conducted at a step width of 0.005° in the range from 0 to 5°, 10 seconds for each step by the FT method. Curve fitting is applied to the reflectivity curve having been obtained, using the Reflectivity Analysis Program Ver. 1 of MacScience Inc. Each parameter is obtained so that the residual sum of squares between the actually measured value and fitting curve will be minimized. From each parameter, the thickness and density of the lamination layer can be obtained.

The inorganic layer 176 having thickness of not more than 100 nm is insufficient in durability or surface strength, whereby abrasion generated when thick transfer paper is used, the layer is abraded unevenly and transfer performance and uneven transfer are likely to observed. When the thickness excess 1,000 nm, adherence performance and bending resistance are insufficient, and cracking or peeling is likely to occur for repeated use, and it is not preferred in view of productivity as film forming time becomes longer.

The property of the intermediate transfer member will be described. The surface energy is represented by a contact angle against methylene iodide. Hardness is represented by a value measured via nanoindentation method. Roughness is a value measured via an atomic force microscope. Internal stress is a value obtained by measuring compressive force.

The surface energy, hardness, roughness, internal stress, dispersive component of surface energy of the photoreceptor and dispersive component of surface energy of the substrate are described.

<<Contact Angle Against Methylene Iodide>>

The contact angle of methylene iodide is determined five times employing a contact angle meter CA-V, produced by Kyowa Interface Science Co., Ltd. Five times measured values are averaged and each of the average contact angles is obtained. Determination is carried out in an ambience of 20° C. and 50% relative humidity.

Contact angle against methylene iodide can be controlled by selecting gas added in the process of layer forming. High contact angle against methylene iodide tends to be given when hydrogen is employed as the addition gas whereby carbon contained in the raw material resides more in the layer.

<<Hardness Measured by Nanoindentation Method>>

Hardness of the inorganic layer measured by a nanoindentation method is 3-10 GPa, preferably 4-6 GPa.

The method of measuring hardness with a nanoindentation method is a method of calculating plastic deformation hardness from the value obtained by measuring the relationship between a load and push-in depth (amount of displacement) while pushing a very small diamond indenter into a thin film.

In the case of a film thickness of specifically 1 μm or less, it is a feature that no crack on the thin film tends to be generated during push-in, together with no dependence on the substrate property. This is generally usable for measuring matter properties of a very thin film.

Figure 2:
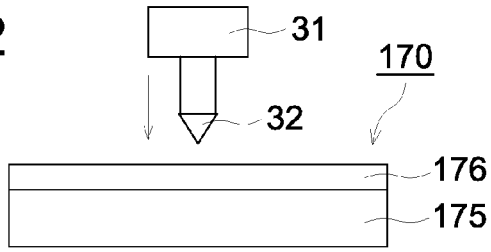
FIG. 2: Conceptual sectional schematic view of an example of a measuring device employing a nanoindentation method.

FIG. 2 is a schematic view of an example of a measuring device employing a nanoindentation method.

In FIG. 2, 31 is a transducer, 32 diamond Berkovich indenter having an equilateral-triangular tip shape, 170 an intermediate transfer member, 175 a substrate and 176 an inorganic layer.

The amount of displacement can be measured to an accuracy of nanometer while applying a load in μN by this measuring device, employing transducer 31 and diamond Berkovich indenter 32 having an equilateral-triangular tip shape. A commercially available "NANO Indenter XP/DCM" (manufactured by MTS Systems Corp./MTS NANO Instruments, Inc.) is usable for this measurement.

Figure 3:
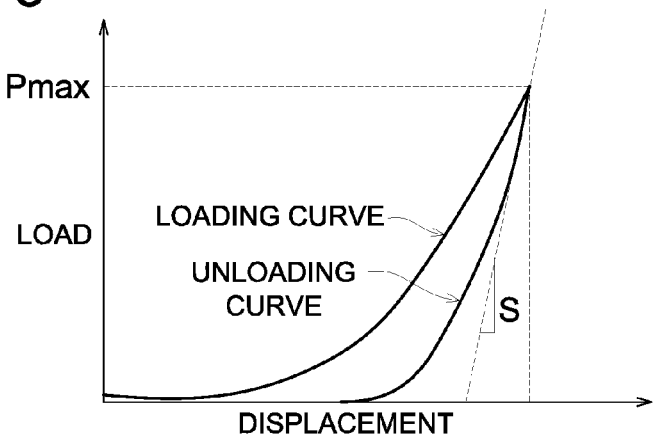
FIG. 3: Typical load-displacement curve obtained by a nanoindentation method.

FIG. 3 shows a typical load-displacement curve obtained by a nanoindentation method.

Figure 4:
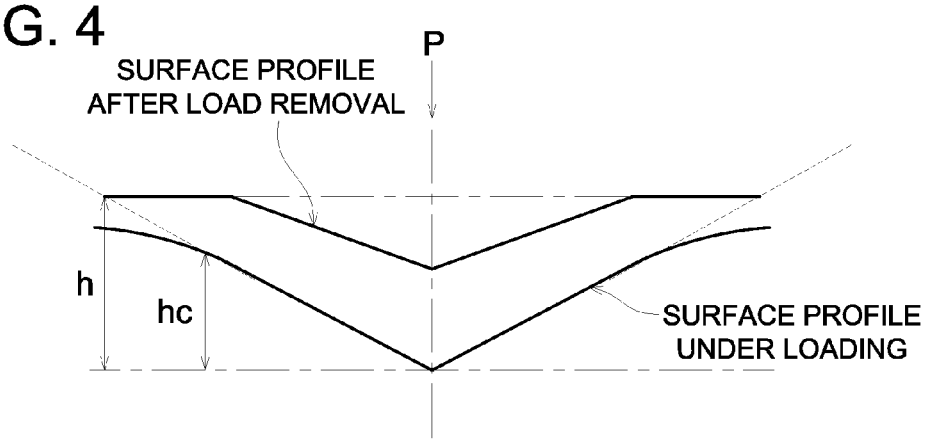
FIG. 4: Diagram showing a contacting situation between an indenter and a test sample.

FIG. 4 is a diagram showing a contacting situation between an indenter and a sample.

Hardness H is determined from the following formula.

$$H=P\max/A \qquad \text{Formula (1)}$$

wherein P is the maximum load, that is the load at which displacement reaches saturated point when load is applied to an indenter, and A is the contact projection area between the indenter and the sample.

Contact projection area A is expressed by the following equation, employing $h_c$ in FIG. 4.

$$A=24.5h_c^2, \qquad \text{Formula (2)}$$

wherein $h_c$, expressed by the following Formula (3), is shallower than total push-in depth h because of elastic indentation of the periphery surface of a contact point as shown in FIG. 4.

$$h_c=h-h_s \qquad \text{Formula (3)}$$

wherein $h_s$ indicates an indentation amount caused by elasticity is expressed by the following formula (4), using a load curve slope after pushing in an indenter, i.e., slope S in FIG. 4, and an indenter shape.

$$h_s=\in\times P/S \qquad \text{Formula (4)}$$

wherein ∈ is a constant concerning the indenter shape to be 0.75 in the case of a Berkovich indenter.

Hardness of the inorganic layer 176 formed on substrate 175 can be measured employing a measuring device with such the nanoindentation method.

Measure Condition

Apparatus: NANO Indenter XP/DCM (manufactured by MTS Systems Corp.)

Indenter: Diamond Berkovich indenter having an equilateral-triangular tip

Circumstances: 20° C., 60% RH

Sample: An intermediate transfer member cut in size of 5 cm×5 cm

Maximum load: 25 μN

Pushing Speed: Speed to reach Maximum load 25 μN for 5 sec., wherein load is applied proportional to time.

Measurement was conducted at 10 points in each sample, and the average value is made as hardness measured via nanoindentation method.

A harder layer can be obtained by employing larger electric source out put or higher temperature substrate whereby decomposition of raw material is promoted.

<<Surface Roughness Measured Via Atomic Force Microscope>>

Surface roughness of the inorganic layer according to this invention is measured by employing an atomic force microscope.

The intermediate transfer member is featured to have surface roughness Rz of 30 to 300 nm measured by employing an atomic force microscope for 10 μm square.

An example of the measuring method of 10 points average surface roughness Rz via atomic force microscope is as follows.

As such atomic force microscope, a probe station SPI 3800N and a multi-functional unit SPA 500, each manufactured by Seiko Instruments Co., Ltd., may be used. A 1 cm square sample is placed on a horizontal sample setting table provided on a piezo scanner and the cantilever is brought close to the sample surface so as to be in the inter atomic force affecting range. Then the sample surface is scanned in the X and Y directions while detecting the unevenness of the surface by variation of the piezo element in the Z direction. As such piezo scanner, one capable of scanning in the range of 20 μm in the X and Y directions and 2 μm in the Z direction is used. As the cantilever, silicon cantilever SI-DF 40P, manufactured by Seiko Instruments Co., Ltd., with a resonance frequency of from 200 to 400 kHz and a spring constant of from 30 to 50 N/m is used. The measurement is performed in the dynamic force mode (DFM). The measuring area of a 10 μm square was measured by one or two viewing fields at a scanning frequency of 0.5 Hz. A slight slant of the sample is calibrated by minimum square approximation of thus obtained three dimensional data, which defines the standard plane. The average surface roughness is determined from three dimensional data by applying the surface roughness analysis of "Analysis Menu" of analyzing software SPIwin. Rz includes 10 points average surface roughness of within the surface and 10 points average surface roughness measured from sectional view profile, and both can be obtained by this analysis menu.

The slower of the layer is formed, the smaller roughness can be obtained, and the higher of the layer is formed, the larger roughness can be obtained.

The internal stress in the inorganic layer is measured by the following method. The prepared sample is set on a thin layer property evaluation apparatus MH4000, manufactured by NEC San-Ei Co., Ltd., so that the concave side of the sample is toward upside and the curling value is measured. Generally, the stress is expressed by plus stress when the curling is plus curl caused by shrinking the layer side by the compressing stress and is expressed by minus stress when the curling is minus curl caused by tensile stress.

The substrate having the inorganic layer formed by, for example, vapor deposition, CVD sol-gel method and so on forms plus curl or minus curl according to the relation of substrate to layer property of the inorganic layer when it is allow to stand in a certain condition. The curl is formed by a stress generated within the inorganic layer, and the larger plus curl is, the larger compression stress is.

Residual stress of the intermediate transfer member after forming silicon oxide layer can be controlled by, for example, controlling degree of vacuum in the process of forming a silicon oxide layer via vacuum vapor deposition method.

Figure 5:
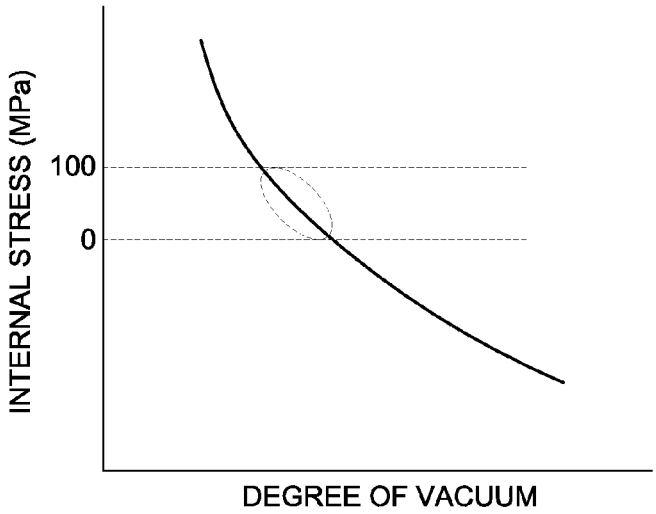
FIG. 5: Relation of the vacuum degree of the chamber when a silicon oxide layer having thickness of 1 μm is formed via vacuum deposition method on a quartz plate having 10 mm width, 50 mm length and 0.1 mm thickness to residual (internal) stress of formed silicon oxide layer measured by above described method.

FIG. 5 shows a relation of degree of vacuum in a chamber to residual stress (internal stress) of the formed silicon oxide layer measured by the above described method in which the silicon oxide is formed by vacuum vapor deposition having 1 mm thickness on a quarts substrate of 10 mm widths, 50 mm length and 0.1 mm thickness.

An inorganic layer having residual stress of not less than 0 up to about 100 MPa in the drawing is preferable. However fine adjustment is difficult in particular a minute control is difficult and sometimes it is not possible to adjust within the range. In case that the residual stress is too small, nondurable inorganic layer having fissures or cracks is formed due to partial tensile stress. In case that the residual stress is too large, fragile and easily peelable inorganic layer is formed.

<<Dispersive Component of Surface Energy of Photoreceptor and Dispersive Component of Surface Energy of Intermediate Transfer Member>>

Dispersive component γD of surface energy of photoreceptor and dispersive component of surface energy γD of intermediate transfer member can be obtained by the following method.

Contact angle between each 3 standard liquid, (i.e., water, nitromethane and methylene iodide) and solid to be measured, (i,e, photoreceptor and intermediate transfer member) is measured 5 times by means of Contact Angle Meter CA-V (Kyowa Interface Science Co., Ltd.), and an average value is obtained. Three components of surface free energy of solid are calculated by Young-Dupre's Formula and Extended Fowkes' Formula. Young-Dupre's Formula:

$$WSL=\gamma L(1+\cos\theta)$$

wherein,

WSL: Adhesion energy of liquid-solid interface

γL: Surface free energy of liquid

θ: Contact angle of liquid-solid interface.

Extended Fowkes' Formula:

$$WSL=2\{(\gamma SD\,\gamma LD)^{1/2}+(\gamma SP\,\gamma LP)^{1/2}+(\gamma SH\,\gamma LH)^{1/2}\}$$

wherein,

γL=γLD+γLP+γLH: surface free energy of liquid

γS=γSD+γSP+γSH: surface free energy of solid

γD, γP, γH: Dispersive component, dipole component, and hydrogen bond component of surface free energy, respectively.

Dispersive component, dipole component, and hydrogen bond component of surface free energy of are obtained by above mentioned, since contact angle of liquid-solid interface dispersive component, dipole component, and hydrogen bond component of surface free energy of each of water, nitromethane and methylene iodide are known.

Preparation methods of an intermediate transfer member and a photoreceptor will be described.

<Preparation Method of an Intermediate Transfer Member>

The intermediate transfer member has an inorganic layer on a substrate.

A preparation method of the intermediate transfer member will be described by referring an example. The present invention is not restricted to this.

(Substrate)

A preferable example of the substrate is a seamless belt composed of a resin containing electro-conductive agent dispersed therein. Examples of the resin usable for the belt include so-called engineering plastic materials such as polycarbonate, polyimide, polyetherether ketone, polyvinylidene fluoride, an ethylenetetrafluoroethylene copolymer, polyamide, polyphenylene sulfide and so forth. Particularly preferable examples are polycarbonate, polyimide, and polyphenylene sulfide.

Carbon black can also be used as the conductive agent, and neutral or acidic carbon black can be used as the carbon black. The conductive filler may be added in such a way that volume resistance and surface resistance are in the predetermined range, depending on kinds of the employed conductive filler. The consumption amount of the conductive filler is commonly 10-20 parts by weight, and preferably 10-16 parts by weight with respect to 100 parts by weight of resin material. Substrate can be manufactured by a conventional method. For example, a resin as a material is dissolved in an extruder, and rapidly cooled via extrusion with a ring die or a T-die to prepare it.

The substrate may be subjected to such surface treatment as corona treatment, flame treatment, plasma treatment, glow discharge treatment, surface roughening treatment and chemical treatment.

A primer layer may be formed between surface layer 176 and substrate 175 in order to improve adhesion. Primers used for the primer layer include a polyester resin, such as an isocyanate resin, a urethane resin, an acrylic resin, an ethylene vinyl alcohol resin, a vinyl-modified resin, an epoxy resin, a modified styrene resin, a modified silicon resin, alkyl titanate and so forth can be used singly or in combination with at least two kinds. A known additive can also be added into these primers. The above-described primer can be coated on a substrate employing a conventional method such as a roll coating method, a gravure coating method, a knife coating method, a dip coating method, a spray coating method or the like, and be primed by removing a solvent, a diluent and so forth via drying. The above-described primer preferably has a coating amount of 0.1-5 g/m$^2$ (dry state).

(Inorganic Layer)

An apparatus, method and using gas in the case of forming a surface layer of an intermediate transfer member of the present invention via atmospheric pressure plasma CVD will be described.

Figure 6:
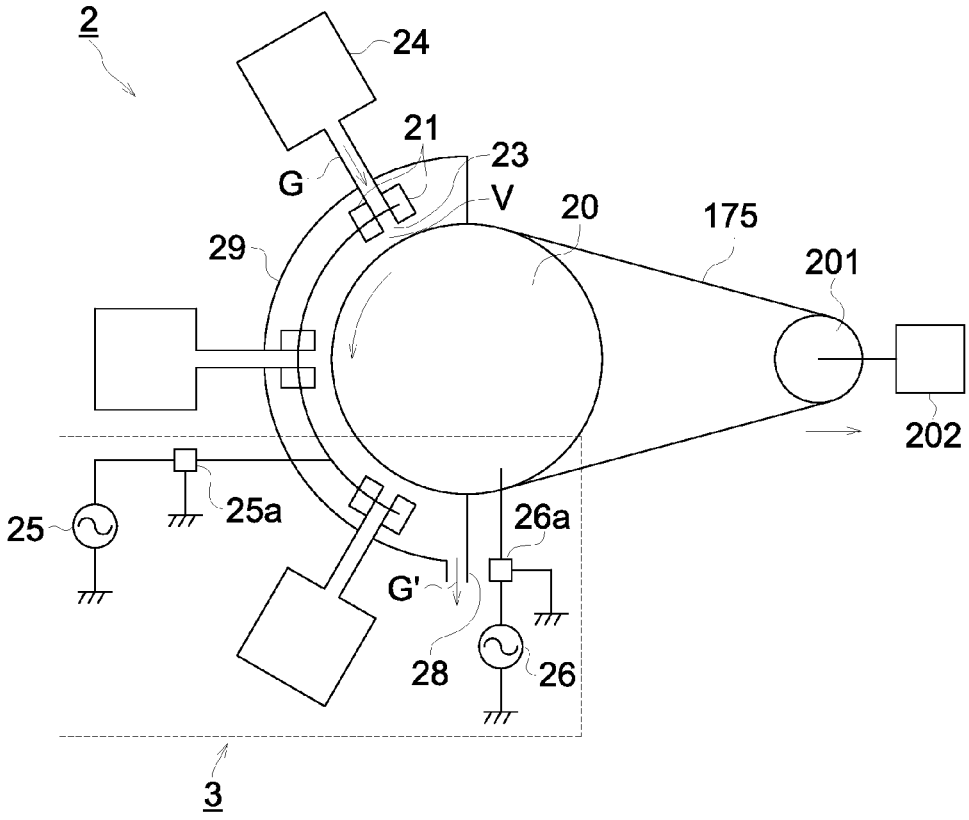
FIG. 6: Schematic diagram of a first manufacturing apparatus to produce an intermediate transfer member.

FIG. 6 is a schematic diagram of the first manufacturing apparatus to produce an intermediate transfer member.

Apparatus 2 manufacturing an intermediate transfer member is a direct type in which the electric discharge space and the thin film depositing area are substantially identical, which forms surface layer 176 on substrate 175, includes: roll electrode 20 that rotatably supports substrate 175 of endless belt-shaped intermediate transfer member 170 and rotates in the arrow direction; driven roller 201; and atmospheric pressure plasma CVD device 3 which is a film-forming device to form surface layer 176 on the surface of substrate 175.

Atmospheric pressure plasma CVD device 3 includes: at least one set of fixed electrode 21 disposed along the outer circumference of roll electrode 20; electric discharge space 23 which is a facing region between fixed electrode 21 and roll electrode 20 where electric discharge is performed; mixed gas supply device 24 which produces mixed gas G of at least a raw material gas and a discharge gas to supply mixed gas G to discharge space 23; electric discharge container 29 which reduces air flow into, for example, discharge space 23; first power supply 25 connected to roll electrode 20; second power supply 26 connected to fixed electrode 21; and gas exhaustion section 28 for used exhausting gas G'.

Mixed gas supply device 24 supplies a mixed gas of a raw material gas and nitrogen gas or a rare gas such as argon gas, into the discharge space, in order to form a film having at least one layer selected from an inorganic oxide layer, an inorganic nitride layer and an inorganic carbide layer. Oxygen gas or hydrogen gas is preferably mixed to progress reaction by redox reaction.

Driven roller 201 is pulled in the arrow direction by tension-providing unit 202 and applies a predetermined tension to substrate. The tension-providing unit releases providing of tension, for example, during replacement of substrate, allowing easy replacement of substrate.

First power supply 25 provides a voltage of frequency ω1, second power supply 26 provides a voltage of frequency of ω2, and these voltages generate electric field V where frequencies ω1 and ω2 are superposed in discharge space 23. Electric field V makes mixed gas G at plasma state to deposit a film (inorganic layer 176) on the surface of substrate 175, corresponding to the raw material gas contained in mixed gas G.

Inorganic layer 176 may be deposited in lamination employing the mixed gas supply devices and the plural fixed electrodes disposed on the downstream side with respect to the rotation direction of the roll electrode, among the plural fixed electrodes, so as to adjust the thickness of inorganic layer 176.

Inorganic layer 176 may be deposited employing the mixed gas supply devices and the fixed electrodes disposed on the downstream side with respect to the rotation direction of the roll electrode, among the plural fixed electrodes, while another layer, for example, a adhesive layer to improve adhesion between inorganic layer 176 and substrate 175, may be formed by the other mixed gas supply devices and fixed electrodes disposed on the upper stream side.

Further, in order to improve adhesion between inorganic layer 176 and substrate 175, gas supply devices to supply gas, such as argon gas or oxygen gas, and fixed electrodes may be arranged on the upstream side of the fixed electrodes and the mixed gas supply devices that form inorganic layer, so as to conduct a plasma treatment and thereby activating the surface of substrate.

As described above, an intermediate transfer belt being an endless belt is tension-supported by a pair of rollers; one of the pair of rollers is used for one of a pair of electrodes; at least one fixed electrode as the other electrode is provided along the outer circumferential surface of the roller which works as the one electrode; an electric filed is generated between the pair of electrodes at an atmospheric pressure or an approximately atmospheric pressure to perform plasma discharge, so that a thin film is deposited and formed on the surface of the intermediate transfer member. Thus, it is possible to provide an intermediate transfer member exhibiting high transferability, high cleaning performance and high durability.

Figure 7:
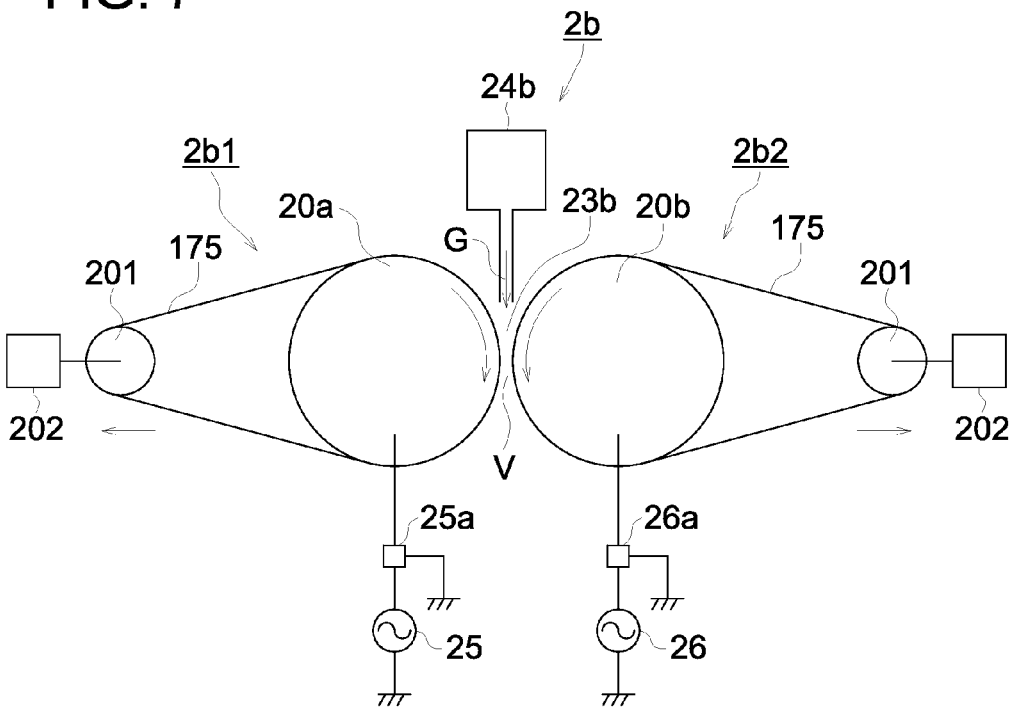
FIG. 7: Schematic diagram of a second manufacturing apparatus to produce an intermediate transfer member.

FIG. 7 is a schematic diagram of a second manufacturing apparatus to produce an inorganic layer of an intermediate transfer member.

Another manufacturing apparatus 2*b* for an intermediate transfer member forms a inorganic layer on each of plural substrates simultaneously, and mainly includes plural film-forming devices 2*b*1 and 2*b*2 each of which forms a inorganic layer on each of the substrate surfaces.

Second manufacturing apparatus 2*b*, which is modification of a direct type, that performs electric discharge between facing roll electrodes to deposit a thin film, includes: first film-forming device 2*b*1; second film-forming device 2*b*2 being disposed in a substantial mirror image relationship at a predetermined distance from first film-forming device 2*b*1; and mixed gas supply device 24*b* that produces mixed gas G of at least a raw material gas and a discharge gas to supply mixed gas G to electric discharge space 23*b*, mixed gas supply device 24*b* being disposed between first film-forming device 2*b*1 and second film-forming device 2*b*2.

First film-forming device 2*b*1 includes: roll electrode 20*a* and driven roller 201 that rotatably support a substrate 175 of an endless belt shaped intermediate transfer member and rotate it in the arrow direction; tension-providing unit 202 that pulls the driven roller 201 in the arrow direction; and first power supply 25 connected to roll electrode 20*a*. Second film-forming device 2*b*2 includes: roll electrode 20*b* and driven roller 201 that rotatably support substrate 175 of an intermediate transfer member in an endless form and rotate it in the arrow direction; tension-providing unit 202 that pulls driven roller 201 in the arrow direction; and second power supply 26 connected to roll electrode 20*b*.

Further, second manufacturing apparatus 2*b* includes electric discharge space 23*b* where electric discharge is performed in a facing region between roll electrode 20*a* and roll electrode 20*b*.

Mixed gas supply device 24*b* supplies a mixed gas of a raw material gas, and nitrogen gas or a rare gas such as argon gas, into discharge space 23*b*, in order to form a film having at least one layer selected from an inorganic oxide layer, an inorganic nitride layer and an inorganic carbide film.

First power supply 25 provides a voltage of frequency ω1, second power supply 26 provides a voltage of frequency of ω2, and these voltages generate electric field V where frequencies ω1 and ω2 are superposed in discharge space 23*b*. Electric field V excites mixed gas G to make plasma state. Surfaces of substrates of first film-forming device 2*b*1 and second film-forming device 2*b*2 are exposed to excited mixed gas as plasma state, so as to deposit and form inorganic layer 175 on the surfaces of substrate of first film-forming device 2*b*1 and inorganic layer 175 on the substrate of second film-forming device 2*b*2 simultaneously, corresponding to the raw material gas contained in the excited mixed gas as plasma state.

Facing roll electrode 20*a* and roll electrode 20*b* are arranged at a predetermined distance between them.

Embodiments of the atmospheric pressure plasma CVD apparatus by which inorganic layer 176 is formed on substrate 175 will be described.

Figure 8:
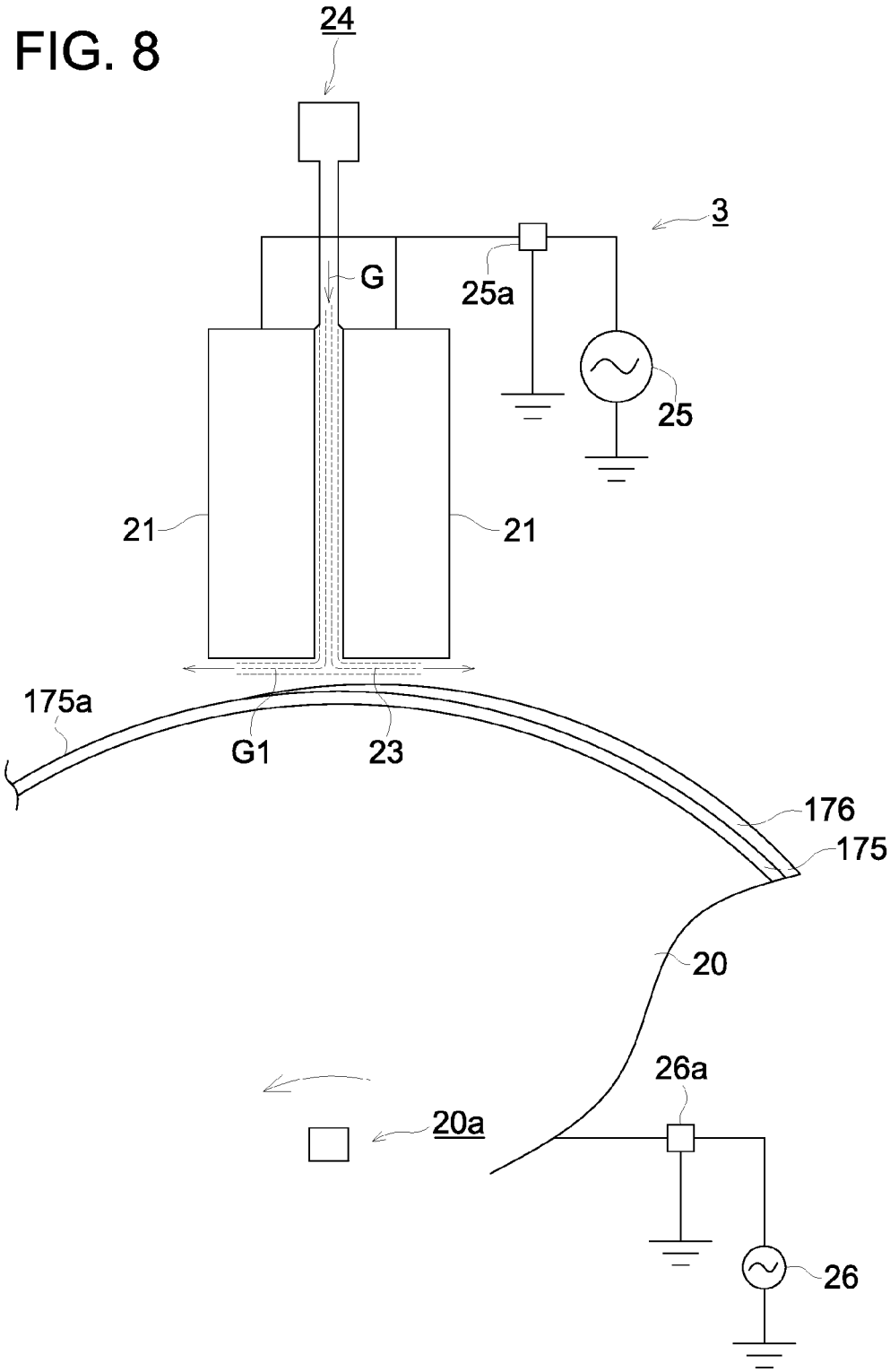
FIG. 8: Schematic diagram of a first plasma film-forming apparatus to produce an intermediate transfer member employing plasma.

FIG. 8 is a partial view in which the dashed area in FIG. 6 is mainly extracted.

FIG. 8 is a schematic diagram of a first plasma film-forming apparatus to produce an inorganic layer of an intermediate transfer member employing plasma.

An example of an atmospheric pressure plasma CVD apparatus which is preferably used to form the inorganic layer will be described, referring to FIG. 8.

Atmospheric pressure plasma CVD apparatus 3 includes at least one pair of rollers for rotatably supporting a substrate, which can be loaded and unloaded, and rotationally drive the substrate, and includes at least one pair of electrodes for performing plasma discharge, wherein one electrode of the pair of electrodes is one roller of the pair of rollers, and the other electrode is a fixed electrode facing the one roller through the substrate. Atmospheric pressure plasma CVD apparatus is an apparatus of manufacturing an intermediate transfer member and exposes the substrate to plasma generated in the facing area between the one roller and the fixed electrode so as to deposit and form the foregoing surface layer. Atmospheric pressure plasma CVD device is preferably used in the case of employing nitrogen gas as discharge gas, for example, and applies a high voltage via one power supply, and applies a high frequency via another power supply so as to start discharging stably and perform discharge continuously.

Atmospheric pressure plasma CVD apparatus 3 includes mixed gas supply device 24, fixed electrode 21, first power supply 25, first filter 25*a*, roll electrode 20, drive unit 20*a* for rotationally driving the roll electrode in the arrow direction, second power supply 26, and second filter 26*a*, and performs plasma discharge in discharge space 23 to excite mixed gas G of a raw material gas with a discharge gas, and exposes substrate surface 175*a* to excited mixed gas G1 so as to deposit and form surface layer 176 on the substrate surface.

The first high frequency voltage of frequency of ω1 is applied to fixed electrode 21 from first power supply 25, and a high frequency voltage of frequency of ω2 is applied to roll electrode 20 from second power supply 26. Thus, an electric field is generated between fixed electrode 21 and role electrode 20 where frequency ω1 at electric field intensity $V_1$ and frequency ω2 at electric field intensity $V_2$ are superposed. Current $I_1$ flows through fixed electrode 21, current $I_2$ flows through roll electrode 20, and plasma is generated between the electrodes.

The relationship between frequency col and frequency ω2, and the relationship between electric field intensity $V_1$, electric field intensity $V_2$, and electric field intensity IV that initiates discharge of discharge gas satisfy ω1<ω2, and satisfy $V_1 \geqq IV > V_2$ or $V_1 > IV \geqq V_2$, wherein the output density of the second high frequency electric field is at least 1 W/cm$^2$.

It is preferable that at least electric field intensity $V_1$ applied from first power supply 25 is 3.7 kV/mm or higher, and electric field intensity $V_2$ applied from second high frequency power supply 60 is 3.7 kV/mm or lower, since electric field intensity IV to start electric discharge of nitrogen gas is 3.7 kV/mm.

As first power supply 25 (high frequency power supply) applicable to first atmospheric pressure plasma CVD apparatus 3, any of the following commercially available power supplies can be used.

| Applied Power supply | Manufacturer | Frequency | Product name |
|---|---|---|---|
| A1 | Shinko Electric Co., Ltd. | 3 kHz | SPG3-4500 |
| A2 | Shinko Electric Co., Ltd. | 5 kHz | SPG5-4500 |
| A3 | Kasuga Electric Works, Ltd. | 15 kHz | AGI-023 |
| A4 | Shinko Electric Co., Ltd. | 50 kHz | SPG50-4500 |
| A5 | Haiden Laboratory | 100 kHz* | PHF-6k |
| A6 | Pearl Kogyo Co., Ltd. | 200 kHz | CF-2000-200k |
| A7 | Pearl Kogyo Co., Ltd. | 400 kHz | CF-2000-400k |
| A8 | SEREN IPS | 100-460 kHz | L3001 |

As second power supply 26 (high frequency power supply), any of the following commercially available power supplies can be used.

| Applied Power supply | Manufacturer | Frequency | Product name |
|---|---|---|---|
| B1 | Pearl Kogyo Co., Ltd. | 800 kHz | CF-2000-800k |
| B2 | Pearl Kogyo Co., Ltd. | 2 MHz | CF-2000-2M |
| B3 | Pearl Kogyo Co., Ltd. | 13.56 MHz | CF-5000-13M |
| B4 | Pearl Kogyo Co., Ltd. | 27 MHz | CF-2000-27M |
| B5 | Pearl Kogyo Co., Ltd. | 150 MHz | CF-2000-150M |
| B6 | Pearl Kogyo Co., Ltd. | 22-99.9 MHz | RP-2000-20/100M |

Regarding the above described power supplies, the power supply marked * is an impulse high frequency power supply of Haiden Laboratory (100 kHz in continuous mode). High frequency power supplies other than the power supply marked * are capable of applying only continuous sine waves.

Regarding the power supplied between the facing electrodes from the first and second power supplies, a power (output density) of at least 1 W/cm$^2$ is supplied to fixed electrode 21 so as to excite discharge gas, and plasma is generated to form a thin film. The upper limit of the power to be supplied to fixed electrode 21 is preferably 50 W/cm$^2$, and more preferably 20 W/cm$^2$. The lower limit is preferably 1.2 W/cm$^2$. Herein, the discharge area (cm$^2$) means the area of the range where discharge is generated at the electrode.

The output density can be improved while maintaining uniformity of the high frequency electric field by supplying roll electrode 20 with a power (output density) of at least 1 W/cm$^2$. Thus, plasma with highly even density can be generated, which improves both a film-forming rate and film quality. The power is preferably at least 5 W/cm$_2$. The upper limit of the power to be supplied to roll electrode 20 is preferably 50 W/cm$^2$.

Herein, waveforms of high frequency electric fields are not specifically limited, and can be in continuous oscillation mode of a continuous sine wave form called a continuous mode, and also in intermittent oscillation mode called a pulse mode performing ON/OFF intermittently, either of which may be employed. However, at least, the high frequency to be supplied to roll electrode 20 preferably has a continuous sine wave to obtain a dense film exhibiting good quality.

First filter 25*a* is provided between fixed electrode 21 and first power supply 25 to allow a current to flow easily from first power supply 25 to fixed electrode 21, and the current from second power supply 26 is grounded to inhibit a current running from second power supply 26 to first power supply 25. Second filter 26*a* is provided between roll electrode 20 and second power supply 26 to allow a current to flow easily from second power supply 26 to roll electrode 20, and the current from first power supply 21 is grounded to inhibit a current running from first power supply 25 to second power supply 26.

It is preferable to employ electrodes capable of applying a high electric field, and maintaining a uniform and stable discharge state. For durability against discharge by a high electric field, the dielectric material described below is coated on at least one surface of each of fixed electrode 21 and roll electrode 20.

In the above description, regarding the relationship between the electrode and the power supply, second power supply 26 may be connected to fixed electrode 21, and first power supply 25 may be connected to roll electrode 20.

Figure 9A:
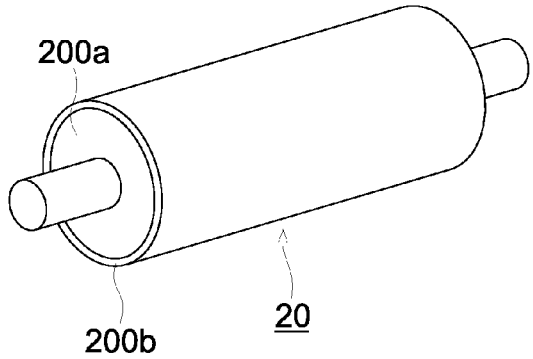
FIGS. 9*a* and 9*b*: Schematic diagrams each showing an example of the roll electrode.
Figure 9B:
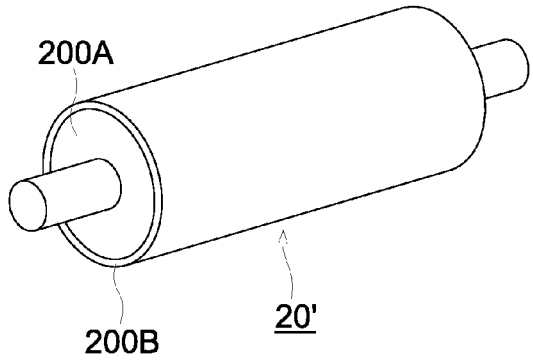

FIGS. 9*a* and 9*b* are a schematic diagram showing an example of the roll electrode.

The structure of roll electrode 20 will be described below. As shown in FIG. 9*a*, roll electrode 20 is constructed with conductive base material 200*a* (hereinafter, referred to also as "electrode base material") made of metal or the like, onto which ceramic-coated dielectric material 200*b* (hereinafter, also referred to simply as "dielectric material") which has been subjected to a sealing treatment with an inorganic material after thermally spraying is coated. As the ceramic material to be used for spraying, alumina, silicon nitride or the like is preferably used, but alumina is specifically preferable in view of easy workability.

Further, as shown in FIG. 9*b*, roll electrode 20' may be constructed with conductive base material 200A made of metal or the like onto which lining-treated dielectric material 200B fitted with an inorganic material by lining is coated. As the lining material, silicate glass, borate glass, phosphate glass, germinate glass, tellurite glass, aluminate glass, vanadate glass or the like is preferably used, but borate glass is specifically preferable in view of easy workability.

Examples of conductive base materials 200*a* and 200A made of metal or the like include silver, platinum, stainless steel, aluminum, titanium, iron and so forth, but stainless steel is preferable in view of easy workability.

In the present embodiment, a stainless-steel jacket-roll base material (not shown) fitted with a cooling device by using cooling water is employed for base materials 200*a* and 200A of the roll electrodes.

Figure 10A:
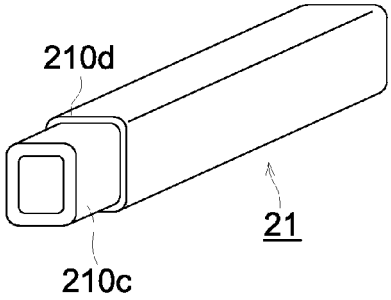
FIGS. 10*a* and 10*b*: Schematic diagrams showing examples of fixed electrodes.
Figure 10B:
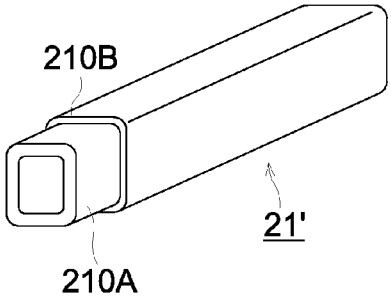

FIGS. 10*a* and 10*b* each is a schematic diagram showing an example of fixed electrodes.

Fixed electrode 21 of a prismatic or rectangular tube is constructed, similarly to the above-described roll electrode 20, with conductive base material 210*c* made of metal or the like, onto which ceramic-coated dielectric material 200*d* which has been subjected to a sealing treatment with an inorganic material after thermally spraying is coated, in FIG. 10*a*. Further, as shown in FIG. 10*b*, fixed electrode 21' of a prismatic or rectangular tube may be constructed with conductive base material 210A made of metal or the like, onto which lining-processed dielectric material 210B fitted with an inorganic material by lining is coated.

An example of a film-forming process in which inorganic layer 176 is formed and deposited on substrate 175 among processes in a method of manufacturing an intermediate transfer member will be described below, referring to FIGS. 6 and 8.

Substrate 175 is tension-supported around roll electrode 20 and driven roller 201, then a predetermined tension is applied to substrate 175 via operation of tension-providing unit 202, and thereafter, roll electrode 20 is rotationally driven at a predetermined rotation speed in FIGS. 6 and 8.

Mixed gas supply device 24 produces mixed gas G and mixed gas G is introduced into electric discharge space 23.

A voltage of frequency ω1 is output from first power supply 25 to be applied to fixed electrode 21, and a voltage of frequency ω2 is output from second power supply 26 to be applied to roll electrode 20. These voltages generate electric field V in discharge space 23 with frequency ω1 and frequency ω2 superposed with each other.

Mixed gas G introduced into discharge space 23 is excited by electric field V to make a plasma state. Then, the surface of the substrate is exposed to mixed gas G in the plasma state, and inorganic layer 176 possessing at least one layer selected from an inorganic oxide film, an inorganic nitride film and an inorganic carbide film is formed on substrate 175 employing a raw material gas in mixed gas G.

In such a manner, the resulting inorganic layer may be a inorganic layer composed of plural layers, but at least one layer among the plural layers preferably contains carbon atoms in an amount of 0.1-20% by atomic percent determined via XPS measurement of the carbon atom content.

For example, in the above-described atmospheric pressure plasma CVD apparatus 3, the mixed gas (discharge gas) is plasma-excited between a pair of electrodes (roll electrode 20 and fixed electrode 21), and a raw material gas containing carbon atoms existing in this plasma is radicalized to expose the surface of substrate 175 thereto. Upon the surface of substrate 175 exposed to carbon-containing molecules and carbon-containing radicals, they are contained in the inorganic layer.

A discharge gas refers to a gas being plasma-excited in the above described conditions, and can be nitrogen, argon, helium, neon, krypton, xenon or a mixture thereof. Nitrogen, helium and argon are preferably used among them and nitrogen is preferable because of low cost.

As a raw material gas to form a surface layer, an organometallic gas being in a gas or liquid state at room temperature is used, and an alkyl metal compound, a metal alkoxide compound and an organometallic complex compound are specifically used. The phase state of these raw materials is not necessarily a gas phase at normal temperature and pressure. A raw material capable of being vaporized through melting, evaporating, sublimation or the like via heating or reduced pressure with mixed gas supply device 24 can be used either in a liquid phase or solid phase.

The raw material gas is one being in a plasma state in discharge space and containing a component to form a thin film, and is an organometallic compound, an organic compound, an inorganic compound or the like.

Examples of silicon compounds include silane, tetramethoxysilane, tetraethoxysilane (TEOS), tetra-n-propoxysilane, tetra-iso-propoxysilane, tetra-n-butoxysilane, tetra-t-butoxysilane, dimethyldimethoxysilane, dimethyldiethoxysilane, diethyldimethoxysilane, diphenyldimethoxysilane, methyltriethoxysilane, ethyltrimethoxysilane, phenyltriethoxysilane, (3,3,3-trifluoropropyl)trimethoxysilane, hexamethyldisiloxane, bis(dimethylamino)dimethylsilane, bis(dimethylamino)methylvinylsilane, bis(ethylamino)dimethylsilane, N,O-bis(trimethylsilyl)acetamide, bis(trimethylsilyl)carbodiimide, diethylaminotrimethylsilane, dimethylaminodimethylsilane, hexamethyldisilazane, heaxamethylcyclotrisilazane, heptamethylsilazane, nonamethyltrisilazane, octamethylcyclotetrasilazane, tetrakisdimethylaminosilane, tetraisocyanatesilane, tetramethyldisilazane, tris(dimethylamino)silane, triethoxyfluorosilane, allyldimethylsilane, allyltrimethylsilane, benzyltrimethylsilane, bis(trimethylsilyl)acetylene, 1,4-bistrimethylsilyl-1,3-butadiine, di-t-butylsilane, 1,3-disilabutane, bis(trimethylsilyl)methane, cyclopentadiphenyltrimethylsilane, phenyldimethylsilane, phenyltrimethylsilane, propagyltrimethylsilane, tetramethylsilane, trimethylsilylacetylene, 1-(trimethylsilyl)-1-propine, tris(trimethylsilyl)methane, tris(trimethylsilyl)silane, vinyltrimethylsilane, hexamethyldisilane, octamethylcyclotetrasiloxane, tetramethylcyclotetrasiloxane, hexamethylcyclotetrasiloxane and M-silicate 51, but are not limited thereto.

Examples of titanium compounds include organometallic compounds such as tetradimethylamino titanium and so forth; metal hydrogen compounds such as monotitanium, dititanium and so forth; metal halogenated compounds such as titanium dichloride, titanium trichloride, titanium tetrachloride and so forth; and metal alkoxides such as tetraethoxy titanium, tetraisopropoxy titanium, tetrabutoxy titanium and so forth, but are not limited thereto.

Examples of aluminum compounds include aluminum n-butoxide, aluminum s-butoxide, aluminum t-butoxide, aluminum diisopropoxide ethylacetoacetate, aluminum ethoxide, aluminum hexafluoropentanedionato, aluminum isopropoxide, aluminum 4-pentanedionato, dimethyl aluminum chloride and so forth, but are not limited thereto.

Further, the above-described raw material may be used singly, or by mixing components of at least two kinds.

Hardness of the surface layer can be adjusted by a film-forming rate, an addition gas amount ratio, and so forth.

Surface layer 176 is formed on the surface of support 175 to provide an intermediate transfer member exhibiting high transferability together with high cleaning ability and durability.

((Preparation of Photoreceptor))

Preparation of a photoreceptor will be described below, which is composed of an interlayer, a charge generation layer, a charge transport layer a protective layer formed with a photo-cured layer on a substrate.

(Provision of a Substrate)

The substrate is preferably a cylindrical shape and a specific resistance of not more than $10^3$ Ω/cm. Practically it includes a cylindrical aluminum washing after cutting process.

(Interlayer)

An interlayer is formed by coating and drying the interlayer coating liquid containing the foregoing inorganic particles, binder, and a dispersion medium.

Binder resins for the interlayer include polyamide resins, vinyl chloride resins, vinyl acetate resins, and copolymers composed of two or more recurring unit of the above resins. Polyamide resins are preferable since residual potential increase for repeated use can be restrained among them.

Solvents used for preparation of interlayer coating composition is preferably dispersing inorganic particles well as added and dissolving polyamide resin. Practically alcohol having 2 to 4 carbon atoms such as ethanol, n-propyl alcohol, isopropyl alcohol, n-butanol, t-butanol and sec-butanol are preferable in view of good solubility of polyamide resin and coating performance. Content of these solvent is preferably 30 to 100% by weight, more preferably 40 to 100% by weight, and further preferably 50 to 100% by weight in the whole amount of the solvents. Solvent aid employed with the solvent described above to obtain good result includes methanol, benzyl alcohol, toluene, methylene chloride, cyclohexanone, tetrahydrofuran and so on.

Thickness of the interlayer is preferably 0.2 to 40 μm, and more preferably 0.3 to 20 μm.

(Charge Generation Layer)

The charge generation layer comprises a charge generation material (CGM). Binder resin, and other additives may be incorporated as other substance as required.

Known charge generation material (CGM) may be used as the charge generation material (CGM). For example, phthalocyanine pigments, azo pigments, perylene pigments and azulenium pigments may be used.

Known resin can be used as a binder when binder is used as dispersion medium for CGM in the charge generation layer. Most preferable examples of the resins include formal resins, butyral resins, silicone resins, silicone denatured resins, phenoxy resins. Content ratio of the binder to charge generation material is preferably 20 to 600 parts by weight with reference to 100 parts of binder resin. Increase of residual potential due to repeated use can be minimized by employing these resin. Thickness of the charge generation layer is preferably 0.01 to 2 μm.

(Charge Transport Layer)

The charge transport layer is composed of a charge transport material (CTM) and a binder resin. Other additives such as antioxidant may be incorporated as required to form it. Thickness of the transport layer is preferably 5 to 40 μm, and more preferably 10 to 30 μm.

Known charge transport material (CTM) can be used as the charge transport material (CTM). For example, triphenylamine derivatives, hydrazone derivatives, styryl compounds, benzidine compounds and butadiene compounds may be used.

Resins used for the charge transport layer (CTL) include polystyrene, acryl resins, methacryl resins, vinyl chloride resins, vinylacetate resins, polyvinyl butyral resins, epoxy resins, polyurethane resins, phenol resins, polyester resins, alkyd resins, polycarbonate resins, silicone resins, melamine resins, and copolymers composed of two or more recurring unit of these resins. Polymer organic semiconductors such as poly-N-vinylcarbazole are mentioned in addition to the insulating resins.

Most preferable example of the binder for CTL is polycarbonate resins. Polycarbonate resins are most preferable in making dispersion property of CTN and electrophotographic property. Content ratio of the binder resin to charge transport material is preferably 10 to 200 parts by weight with reference to 100 parts of binder resin. Thickness of the charge transport layer is preferably 10 to 40 μm.

Known compounds can be used as antioxidants. Practical example includes IRGANOX by Nihon Ciba Geigy Ltd.

An image forming method and an image forming apparatus are described.

The intermediate transfer medium according to this invention may be applied to an image forming apparatus such as an electrophotographic copying machine, printer and facsimile suitably. The image forming methods include those processes in which a toner image carried on a photoreceptor is primary transferred to a surface of the intermediate transfer member, the transferred toner image is hold, the hold toner image is secondarily transferred to a surface of a transferee such as paper via the intermediate transfer member. The transfer member may be belt shaped or drum shaped.

An image forming apparatus having an intermediate transfer member of this invention will be described with reference to a tandem type full color copying machine.

Figure 11:
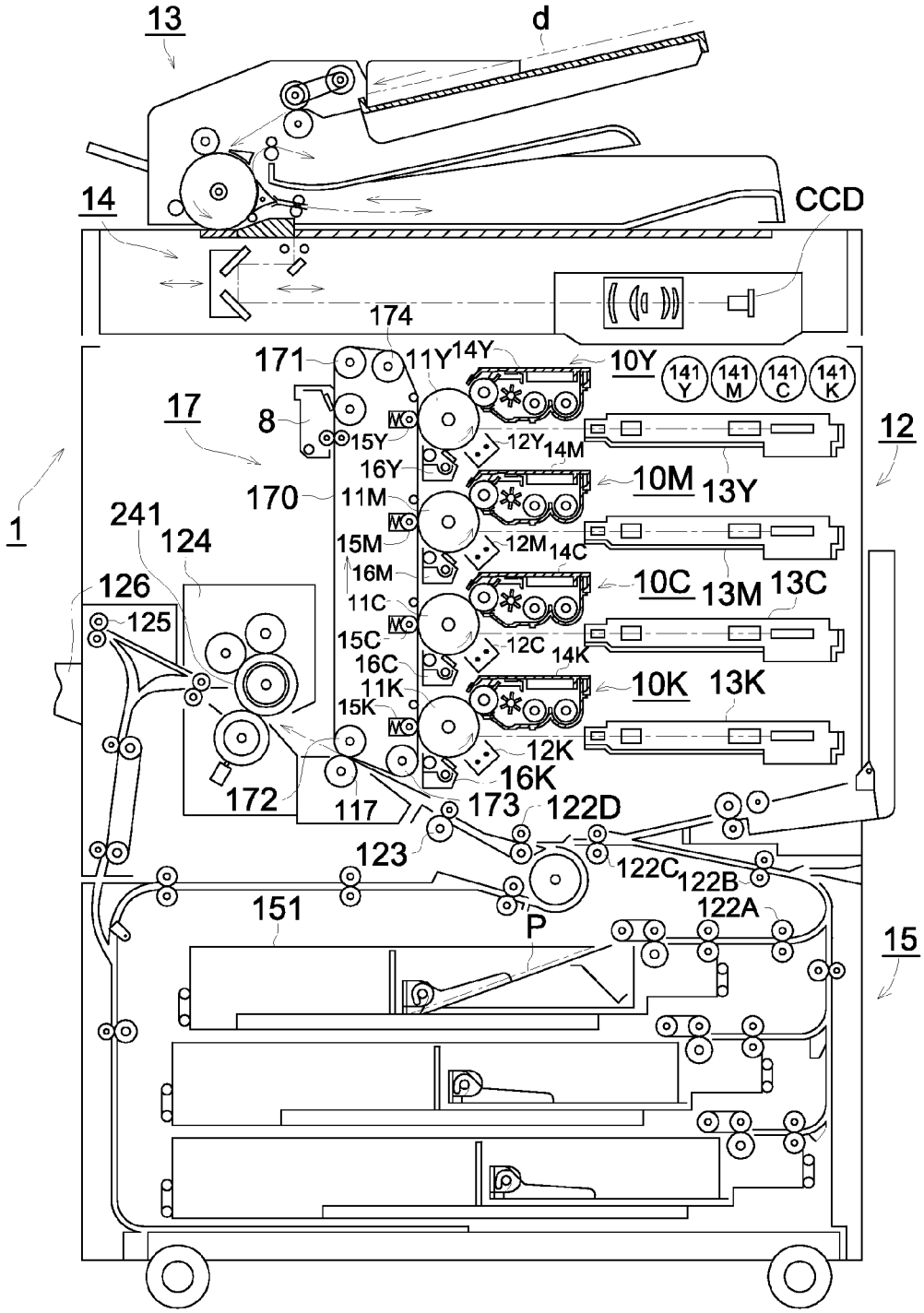
FIG. 11: Cross-sectional schematic view of an example of an image forming apparatus in which the intermediate transfer member of this invention is applicable.

FIG. 11 is a cross-sectional schematic view of an example of a color image forming apparatus.

Color image forming apparatus 1 is called a tandem type full-color copier, and is comprised of automatic document conveying device 13, original document reading device 14, plural exposure units 13Y, 13M, 13C and 13K, plural image forming sections 10Y, 10M, 10C and 10K, intermediate transfer member unit 17, sheet feeding unit 15 and fixing device 124.

Around the upper portion of main body 12 of the image forming apparatus, disposed are automatic document conveying device 13 and original document reading device 14. An image of original document d conveyed by automatic document conveying device 13 is reflected and caused to form an image by an optical system of image reading device 14, and the image is read by line image sensor CCD.

An analog signal produced by photoelectric conversion of an image of an original document read by the line image sensor CCD is subjected, in an image processing section (not shown), to analog processing, A/D conversion, shading calibration, image compression processing and the like, thereafter transmitted to exposure units 13Y, 13M, 13C and 13K as digital image data of the respective colors, and then latent images of the image data of the respective colors are formed by exposure units 13Y, 13M, 13C and 13K on photoreceptors 11Y, 11M, 11C and 11K in the form of drum (hereinafter, also referred to as photoreceptors).

Image forming sections 10Y, 10M, 10C and 10K are disposed in tandem in the vertical direction, and an intermediate transfer member 170, which is a second image carrier being semiconductive and in an endless belt form is arranged on the left side, in the figure, of photoreceptors 11Y, 11M, 11C and 11K.

Intermediate transfer belt 170 of the present invention is driven along the arrow direction through roller 171 which is rotationally driven by a drive unit (not shown).

Image forming section 10Y for forming yellow color images includes charging unit 12Y, exposure unit 13Y, development unit 14Y, primary transfer roller 15Y, and cleaning unit 16Y which are disposed around photoreceptor 11Y.

Image forming section 10M for forming magenta color images includes photoreceptor 11M, charging unit 12M, exposure unit 13M, development unit 14M, primary transfer roller 15M, and cleaning unit 16M.

Image forming section 10C for forming cyan color images includes photoreceptor 11C, charging unit 12C, exposure unit 13C, development unit 14C, primary transfer roller 15C, and cleaning unit 16C.

Image forming section 10K for forming black color images includes photoreceptor 11K, charging unit 12K, exposure unit 13K, development unit 14K, primary transfer roller 15K, and cleaning unit 16K.

Toner supply units 141Y, 141M, 141C and 141K supply new toner to respective development units 14Y, 14M, 14C and 14K.

Primary transfer rollers 15Y, 15M, 15C and 15K are selectively operated by a control unit (not shown) corresponding to the image type, and press intermediate transfer belt 170 against respective photoreceptors 11Y, 11M, 11C and 11K to transfer images on the photoreceptors.

In such a manner, the images in the respective colors formed on photoreceptors 11Y, 11M, 11C and 11K by image forming sections 10Y, 10M, 10C and 10K are sequentially transferred to circulating intermediate transfer belt 170 by primary transfer rollers 15Y, 15M, 15C and 15K so that synthesized color images are formed.

The toner images carried on the surfaces of the photoreceptors are primarily transferred to the surface of the intermediate transfer belt, and the intermediate transfer belt holds the transferred toner image.

Transferee material P as a recording medium stored in sheet supply cassette 151 is fed by sheet feeding unit 151, then conveyed into secondary transfer roller 117 through plural intermediate rollers 122A, 122B, 122C, 122D and registration roller 123, and then the synthesized toner image on the intermediate transfer member is transferred all together onto transferee material P by secondary transfer roller 117.

The toner image held on the intermediate transfer member is secondarily transferred onto the surface of the transferee material.

Secondary transfer roller 117 presses recording medium P against intermediate transfer belt 170 only when recording medium P passes through here to perform secondary transferring.

Transferee material P onto which the color image has been transferred is subjected to a fixing treatment by fixing device 124, and nipped by sheet-ejection rollers 125 to be loaded on sheet-ejection tray 126 equipped outside the apparatus.

Residual toner on intermediate transfer belt 170 having curvature-separated recording sheet P is removed by cleaning unit 8, after the color image is transferred to recording medium P by secondary transfer roller 117.

Herein, the intermediate transfer member may be replaced by a rotatable intermediate transfer drum as described above.

Next, the structure of primary transfer rollers 15Y, 15M, 15C and 15K as first transfer units being in contact with intermediate transfer belt 170, and the structure of secondary transfer roller 117 will be described.

Primary transfer rollers 15Y, 15M, 15C and 15K are formed, for example, by coating the circumferential surface of a conductive core metal of stainless or the like with an outer diameter of 8 mm, with a semiconductive elastic rubber having a thickness of 5 mm and a rubber hardness in an approximate range of 20-70 degrees (Asker hardness C). The semiconductive elastic rubber is prepared by making a rubber material such as polyurethane, EPDM, silicon or the like into a solid state or foam sponge state with a volume resistance in an approximate range of $10^5$-$10^9$ Ω·cm, dispersing conductive filler such as carbon, to the rubber material or having the rubber material contain an ionic conductive material.

Secondary transfer roller 117 is formed, for example, by coating a circumferential surface of a conductive core metal of stainless or the like with an outer diameter of 8 mm, with a semiconductive elastic rubber having a thickness of 5 mm and a rubber hardness in an approximate range from 20 to 70 degrees (Asker hardness C). The semiconductive elastic rubber is prepared by making a rubber material, such as polyurethane, EPDM, silicon or the like into a solid state or foam sponge state with a volume resistance in an approximate range of $10^5$-$10^9$ Ω·cm, dispersing conductive filler such as carbon, to the rubber material or having the rubber material contain an ionic conductive material.

Transferee material used in this invention is a support to hold toner image, and is usually called as an image support material, a transferee material or transferee paper. Specifically it includes usual paper having various thickness, coated printing paper such as art paper or coated paper, Japanese paper or post card on the market, plastic film such as OHP sheet and textile.

EXAMPLE

The present invention will now be specifically described referring to examples.

Preparation of Intermediate Transfer Member

An intermediate transfer member sample was prepared in the following manner.

Preparation of Intermediate Transfer Member 1

Preparation of Substrate

| | |
|---|---|
| Polyphenylenesulfide resin "E2180" (produced by Toray Co., Ltd.) | 100 parts by weight |
| Conductive filler "Furnace #3030B" (produced by Mitsubishi Chemical Corp.) | 16 parts by weight |
| Graft copolymer "MODIPER A4400" (produced by NOF Corp.) | 1 part by weight |
| Lubricant (calcium montanate) | 0.2 parts by weight |

The above-described composition was put into a single-axis extruder, and molten and kneaded to prepare a resin mixture. The resin mixture was extruded into a seamless belt shape through a ring shaped die having a seamless belt-shaped discharge opening attached at the end of the extruder. The extruded seamless belt-shaped resin mixture was introduced into a cooling cylinder provided at a discharging opening, and cooled and solidified to prepare a seamless cylindrical intermediate transfer belt. The resulting substrate had a thickness of 150 μm.

Forming Inorganic Layer

An inorganic compound layer of 250 nm thick was formed on this substrate employing a plasma discharge treatment apparatus shown in FIG. 6 to form intermediate transfer member 1.

Examples of the material used for the surface layer were silicon oxide and aluminum oxide. As a usable dielectric covering each electrode fitted into the plasma discharge treatment apparatus in this case, alumina of a thickness of 1 mm was coated on each of both facing electrodes via thermally sprayed ceramic treatment. The spacing between the electrodes was set to 0.5 mm. A metal base material on which a dielectric was coated was prepared in accordance to the stainless steel jacket specification having a cooling function with cooling water, and the plasma discharge treatment was conducted while controlling electrode temperature with cooling water during discharging.

After vapor is produced by heating each raw material, and is mixed and diluted with a discharge gas and a reactive gas which have been preheated in advance to prevent coagulation, the resulting has been supplied into the discharge space.

(Inorganic Layer of Silicon Oxide Layer)

Discharge gas: $N_2$ gas

Reactive gas: 19% by volume of $O_2$ gas, based on the total gas

Raw material gas: 0.4% by volume of tetraethoxysilane (TEOS), based on the total gas Power supply electric power on the low frequency side {high frequency power supply (50 kHz) manufactured by Shinko Electric Co., Ltd.}: 10 W/cm$^2$ Power supply electric power on the high frequency side {high frequency power supply (13.56 MHz) manufactured by Pearl Kogyo Co., Ltd.}: 5 W/cm$^2$ Preparation of Intermediate Transfer Members 2-4

Intermediate transfer members 2-4 were prepared in the similar manner of the intermediate transfer member 1 by changing the reactive gas, raw material gas and film forming rate of the inorganic layer as shown in Table 1.

Preparation of Intermediate Transfer Member 5

Intermediate transfer member 5 were prepared in the similar manner of the intermediate transfer member 1 except that aluminum s-butoxide was used as the raw material gas and modified as shown in Table 1.

(Inorganic Layer of Aluminum Oxide)

Discharge gas: $N_2$ gas

Reactive gas: 4.0% by volume of $H_2$ gas, based on the total gas

Raw material gas: 0.05% by volume of aluminum s-butoxide, based on the total gas Power supply electric power on the low frequency side {impulse high frequency power supply (100 kHz) manufactured by Haiden Laboratory}: 10 W/cm$^2$ Power supply electric power on the high frequency side {wide band high frequency power supply (40.0 MHz) manufactured by Pearl Kogyo Co., Ltd.}: 5 W/cm$^2$ Preparation of Intermediate Transfer Members 6 and 7

Intermediate transfer members 6 and 7 were prepared in the similar manner of the intermediate transfer member 1 by changing the reactive gas, raw material gas and film forming rate of the inorganic layer as shown in Table 1.

Preparation of Intermediate Transfer Member 8

A film is formed on a same substrate as Example by employing a plasma CVD apparatus Model PD-270STP, product by SAMCO Inc., and evaluation was conducted. The film was formed a part of the intermediate transfer member due to convenience of the film forming apparatus, and the evaluation was conducted for the film formed area only.

(Inorganic Layer of Silicon Oxide Layer)

Discharge gas: $O_2$ gas, 0.08 torr

Reactive gas: Tetraethoxysilane (TEOS), 5 sccm (Standard cubic centimeter per minute)

Power supply: 100 W/cm$^2$, 13.56 MHz

Substrate maintaining temperature: 60° C.

Preparation of Intermediate Transfer Members 9-11

Intermediate transfer members 9-11 were prepared in the same way as the Intermediate transfer member 1 except that the reaction gas, raw material gas, and film forming rate were modified as described in Table 1.

Preparation of Intermediate Transfer Member 12

The substrate prepared by the method as described above was employed for the Intermediate transfer member 12.

Preparation condition, contact angle against methylene iodide, surface hardness, surface roughness, internal stress and surface energy of the Intermediate transfer members are listed in Table 1.

TABLE 1

| | Production Condition | | | | | Characteristics | | | | |
|---|---|---|---|---|---|---|---|---|---|---|
| Intermediate transfer member No. | Production Apparatus | Discharge gas | Reactive gas (vol %) | Raw material gas (vol %) | Film forming rate (nm/sec) | Contact angle against methylene iodide (°) | Surface hardness (GP) | Surface roughness (nm) | Internal stress (MPa) | Dispersive component of surface energy (mN/m) |
| 1 | Plasma CVD | $N_2$ | $O_2$/19 | TEOS/0.4 | 8 | 30 | 5.5 | 60 | 60 | 44.4 |
| 2 | Plasma CVD | $N_2$ | $O_2$/19 | TEOS/1.4 | 21 | 45 | 5 | 80 | 50 | 37.2 |
| 3 | Plasma CVD | $N_2$ | $O_2$/10 | TEOS/1.7 | 24 | 57 | 5 | 80 | 50 | 30.4 |
| 4 | Plasma CVD | $N_2$ | $H_2$/4 | TEOS/2.7 | 34 | 52 | 3 | 120 | 10 | 33.3 |
| 5 | Plasma CVD | $N_2$ | $H_2$/4 | Tri-s-butoxy Al/0.05 | 12 | 31 | 10 | 100 | 90 | 44 |
| 6 | Plasma CVD | $N_2$ | $O_2$/19 | TEOS/2.0 | 33 | 48 | 5 | 190 | 50 | 35.5 |
| 7 | Plasma CVD | $N_2$ | $O_2$/19 | TEOS/2.4 | 36 | 48 | 5 | 300 | 50 | 35.5 |
| 8 | Plasma CVD | $O_2$/(0.08 Torr) | — | TEOS | — | 45 | 5 | 80 | 200 | 37.2 |
| 9 | Plasma CVD | $N_2$ | $O_2$/19 | TEOS/0.25 | 6 | 28 | 6 | 50 | 70 | 45.2 |
| 10 | Plasma CVD | $N_2$ | $O_2$/5 | TEOS/1.7 | 28 | 63 | 4 | 80 | 20 | 27 |

TABLE 1-continued

| | Production Condition | | | | | Characteristics | | | | |
|---|---|---|---|---|---|---|---|---|---|---|
| Intermediate transfer member No. | Production Apparatus | Discharge gas | Reactive gas (vol %) | Raw material gas (vol %) | Film forming rate (nm/sec) | Contact angle against methylene iodide (°) | Surface hardness (GP) | Surface roughness (nm) | Internal stress (MPa) | Dispersive component of surface energy (mN/m) |
| 11 | Plasma CVD | $N_2$ | $H_2$/4 | Tri-s-butoxy Al/0.03 | 9 | 31 | 11 | 90 | 100 | 44 |
| 12 | — | — | — | — | — | 25 | 0.5 | 60 | — | 46.3 |

Contact angle against methylene iodide, surface hardness, surface roughness, internal stress and surface energy were measured by afore described methods.

Production of Photoreceptor

A photoreceptor was produced by forming an inter layer, a charge generation layer, charge transport layer in sequence on a substrate.

Preparation of Substrate

A washed cylindrical aluminum substrate having outer diameter of 100 mm was prepared. This is called "Substrate 100".

Forming Interlayer

The coating composition described below was prepared and applied to the outer surface of Substrate 100 by an immersion coating method, then it was dried at 100° C. for 20 minutes to form an interlayer having fry thickness of 0.3 μm.

| | |
|---|---|
| Polyamide resin AMILAN CM-8000 (by Toray) | 60 parts by weight |
| Methanol | 1,600 parts by weight |

Forming Charge Generation Layer

A charge generation layer coating composition was prepared by mixing and dispersing shown below using a sand mill for 10 hours. The coating composition was coated by means of an immersion coating method on the above-described interlayer, then it was dried at 100° C. for 20 minutes to form a charge generation layer having a thickness of 0.2 μm.

| | |
|---|---|
| Y-type titanyl phthalocyanine (Maximum peak angle 2θ by Cu—K a characteristic X-ray of 27.3°) | 60 parts by weight |
| Silicone resin solution (KR 5240, 15% xylene butanol solution, (by Shin-Etsu Chemical Co., Ltd.) | 700 parts by weight |
| 2-butanone | 2,000 parts by weight |

Forming Charge Transport Layer

A charge transport layer coating composition was prepared by mixing and dissolving shown below. The coating composition for the charge transport layer was coated by means of an immersion coating method on the above-described charge generation layer, then it was dried at 100° C. for 60 minutes to form a charge generation layer having a thickness of 20 μm.

| | |
|---|---|
| Charge transport material (4,4'-dimethyl-4"-(α-phenylstyryl) triphenyl amine) | 150 parts by weight |
| Bisphenol Z type polycarbonate (IUPILON Z300, by Mitsubishi Gas Chemical Company INC.) | 300 parts by weight |
| Tetrahydrofuran | 1,600 parts by weight |
| Toluene | 400 parts by weight |
| Anti-oxidant SUMILIZER BHT (by Sumitomo Chemical Co., Ltd.) | 2.5 parts by weight |

The dispersive component of the surface energy of the photoreceptor measured by above described method was 9.7 mN/m.

(Evaluation)

The above produced intermediate transfer members were evaluated in sequence as they were installed in an image forming apparatus "8050" (Konica Minolta Business Technologies, Inc.) provided with above prepared photoreceptor.

Two component developer composed of a toner having volume based median particle diameter ($D_{50}$) of 4.5 μm and a carrier having 60 μm was employed for the image forming.

Test printing was conducted in environmental conditions of low temperature and low humidity (10° C., 20% RH) and high temperature and high humidity (33° C., 80% RH). A4-size high quality paper (64 g/m2) was employed for the transferee.

A4-size original having four quarter images comprising a character image having pixel ratio of 7% and 3-point and 5-point characters, a color portrait image (dot images including half tone) white solid image and black solid image was employed for the print test. The following items were evaluated. Ranks A and B are acceptable and C is not acceptable.

Secondary Transfer Efficiency

Secondary transfer efficiency was evaluated by transfer ratio at the initial and 160 thousandth prints at low temperature and low humidity environmental condition (10° C., 20% RH). The transfer ratio was tested by forming solid image of 20 mm×50 mm with pixel density of 1.30, toner weight transferred on the transferee material and toner weight provided on the intermediate transfer member were measured, and the ratio was calculated by the following formula.

Transfer ratio(%)=(Toner weight transferred on the transferee material)/(Toner weight provided on the intermediate transfer member)×100

Transfer ratio of 90% or higher is estimated as "good".

Cleaning Performance

Cleaning performance was evaluated by that prints were made at low temperature and low humidity environmental condition (10° C., 20% RH), then surface of the intermediate transfer member subjected to cleaning with blade was visually observed, and a degree of remaining toner on the surface was evaluated. Degree of generation of image stain on the print image due to cleaning defect was also evaluated.

Turn over of the cleaning blade generated during printing was also evaluated as the cleaning performance.

Criteria

A: Remaining toner on the intermediate transfer member after cleaning was not observed and image stain due to cleaning defect on the print image was not observed, up to 160 thousandth prints.

B: Remaining toner on the intermediate transfer member after cleaning was observed however image stain due to cleaning defect on the print image was not observed, at 160 thousandth prints.

C: Remaining toner on the intermediate transfer member after cleaning was observed and image stain due to cleaning defect on the print image was observed, at 100 thousandth prints, the print was not practically acceptable.

Hollow Characters

Hollow characters was evaluated by that the 10 sheets of initial print and 10 sheets of 160 thousandth print at high temperature and high humidity (33° C., 80% RH) were took out and degree of hollow characters were evaluated by observing character magnified with a magnifier.

Criteria

A: Three or less hollow characters were observed on each of all 10 sheets, "good".

B: Four to nineteen hollow characters were observed on one sheet, "practically no problem".

C: Twenty or more hollow characters were observed on one or more sheets, "practically problem".

The result is summarized in Table 2.

TABLE 2

| | Intermediate transfer member | Photo-receptor | Secondary Transfer Efficiency Initial | Secondary Transfer Efficiency After 160 thousand | Cleaning performance | Degree of hollow characters |
|---|---|---|---|---|---|---|
| Example 1 | 1 | 1 | 91 | 90 | B | A |
| Example 2 | 2 | 1 | 98 | 96 | A | B |
| Example 3 | 3 | 1 | 98 | 97 | A | B |
| Example 4 | 4 | 1 | 98 | 96 | A | B |
| Example 5 | 5 | 1 | 96 | 94 | A | A |
| Example 6 | 6 | 1 | 98 | 96 | A | B |
| Example 7 | 7 | 1 | 93 | 91 | B | B |
| Example 8 | 8 | 1 | 98 | 90 | B | B |
| Comparative Example 1 | 9 | 1 | 89 | 86 | B | A |
| Comparative Example 2 | 10 | 1 | 98 | 97 | A | C |
| Comparative Example 3 | 11 | 1 | 98 | *1 | B | — |
| Comparative Example 4 | 12 | 1 | 90 | 87 | A | C |

*1: Transfer efficiency could not be measured due to generation of cracking and peeling off of inorganic layer.

Good result was obtained by the intermediate transfer members 1 through 7 in Examples 1 through 7 according to this invention in any items of secondary transfer efficiency, hollow characters and cleaning performance in the initial and 160 thousandth prints, however Example 8, included in the Example, has internal stress exceeding the preferable range and the secondary transfer efficiency after 160 thousand prints was inferior to other samples as reduced by 10%. The intermediate transfer members 9 through 12 in the Comparative Examples 1 through 4 has problems in any one of the evaluation items, and shows different result from the intermediate transfer members of this invention.

The invention claimed is:

1. An intermediate transfer member employed in an image forming apparatus which includes means of, after primarily transferring a toner image held on a surface of an electrophotographic photoreceptor to an intermediate transfer member, secondarily transferring the toner image from the intermediate transfer member to a transferee material, wherein the intermediate transfer member comprises an inorganic layer provided at an uppermost layer thereof, a contact angle of the inorganic layer against methylene iodide is 30 to 60°, and a hardness of the inorganic layer measured by a nanoindentation method is 3-10 GPa.

2. The intermediate transfer member of claim 1, wherein a 10 points average surface roughness Rz of the inorganic layer is 30 to 300 nm measured by employing an atomic force microscope.

3. The intermediate transfer member of claim 1, wherein an internal stress of the inorganic layer is not more than 100 MPa and not less than 0.01 MPa.

4. The intermediate transfer member of claim 1, wherein the inorganic layer is formed of at least one of a silicon oxide layer and a metal oxide layer.

5. The intermediate transfer member of claim 1, wherein the inorganic layer is formed by atmospheric pressure plasma CVD.

6. The intermediate transfer member of claim 1, wherein a substrate of the intermediate transfer member is a resin.

7. The intermediate transfer member of claim 6, wherein the substrate of the intermediate transfer member is polycarbonate, polyimide or polyphenylene sulfide.

8. An image forming method employing the intermediate transfer member of claim 1.

9. An image forming apparatus employing the intermediate transfer member of claim 1.

10. An image forming method comprising steps of;

primarily transferring a toner image held on a surface of an electrophotographic photoreceptor to an intermediate transfer member, and secondary transferring the toner image from the intermediate transfer member to a transferee material, wherein the intermediate transfer member comprises an inorganic layer provided at an uppermost layer thereof, a contact angle of the inorganic layer against methylene iodide is 30 to 60°, and a hardness of the inorganic layer measured by a nanoindentation method is 3-10 GPa.

11. The image forming method of claim 10, wherein a 10 points average surface roughness Rz of the inorganic layer is 30 to 300 nm measured by employing an atomic force microscope.

12. The image forming method of claim 10, wherein an internal stress of the inorganic layer is not more than 100 MPa and not less than 0.01 MPa.

13. The image forming method of claim 10, wherein the inorganic layer is formed of at least one of a silicon oxide layer and a metal oxide layer.

14. The image forming method of claim 10, wherein the inorganic layer is formed by atmospheric pressure plasma CVD.

15. The image forming method of claim 10, wherein a substrate of the intermediate transfer member is a resin.

16. The image forming method of claim 15, wherein the resin is polycarbonate, polyimide or polyphenylene sulfide.

* * * * *